United States Patent [19]

Sonoda et al.

[11] Patent Number: 4,649,874

[45] Date of Patent: Mar. 17, 1987

[54] OIL SUPPLY SYSTEM FOR VALVES IN AN INTERNAL COMBUSTION ENGINE

[75] Inventors: Toshinari Sonoda; Yutaka Koinuma, both of Saitama, Japan

[73] Assignee: Honda Giken Kogyo Kabushiki Kaisha, Tokyo, Japan

[21] Appl. No.: 853,469

[22] Filed: Apr. 18, 1986

[30] Foreign Application Priority Data

Apr. 18, 1985 [JP] Japan ..... 60-83388

[51] Int. Cl.[4] ..... F01M 9/10; F01L 1/26

[52] U.S. Cl. ..... 123/90.36; 123/90.23; 123/90.27; 123/90.44

[58] Field of Search ..... 123/90.36, 90.33, 90.55, 123/90.22, 90.23, 90.27, 90.44

[56] References Cited

U.S. PATENT DOCUMENTS

| | | | |
|---|---|---|---|
| 1,792,836 | 2/1931 | Handwerker | 123/90.36 |
| 3,048,156 | 8/1962 | Van Slooten | 123/90.36 |
| 3,146,767 | 9/1964 | Dadd | 123/90.36 |
| 3,179,094 | 4/1965 | Ribeton | 123/90.36 |
| 3,897,761 | 8/1975 | Fleischer et al. | 123/90.36 |
| 4,527,518 | 7/1985 | Osaki et al. | 123/90.23 |

*Primary Examiner*—Ira S. Lazarus

*Attorney, Agent, or Firm*—Lyon & Lyon

[57] ABSTRACT

An oil supply system for the overhead valve actuating mechanism of an internal combustion engine. A cam follower is engaged by a hydraulic tappet for constantly maintaining positive contact among the valve actuating mechanism components including a rocker arm pivotally mounted on a rocker shaft and engaging the end of the valve for opening same and a pusher rod extending between the rocker arm and the cam follower. Oil is supplied under pressure to the hydraulic tappet for operating same and from a reservoir chamber in the tappet through oil passages in the cam follower, pusher rod and rocker arm to lubricate the rocker shaft and the points of engagement between those components.

5 Claims, 3 Drawing Figures

OIL SUPPLY SYSTEM FOR VALVES IN AN INTERNAL COMBUSTION ENGINE

The present invention relates to an oil supply system for overhead valves in an internal combustion engine that includes an interlinking mechanism operatively connecting the cam of a camshaft and the head of a valve with a hydraulic tappet for continually maintaining contact with the valve head, wherein the oil supply system is effective in supplying operating oil to the hydraulic tappet and lubricating oil to the other components.

In a typical conventional oil supply system, as shown in FIGS. 2 and 3, for the overhead valve operating mechanism of an internal combustion engine, an oil supply passage 31 is provided in an engine cylinder head 1 and communicates with the outlet port of an oil pump 32 (shown diagrammatically). The oil supply passage 31 is connected to operating oil passages 30 communicating with each of the hydraulic tappets 12 and a lubricating oil passage 40 communicating with the bore 16*a* defined in a rocker arm shaft 16 on which a plurality of rocker arms 15 are supported. The rocker arm shaft 16 has oil holes 41 defined therein to provide communication between the bore 16*a* and the bearing bore 15*a* of each of the rocker arms 15.

Generally, in the prior conventional systems shown in FIGS. 2 and 3, the rocker armshaft 16 is pushed laterally to one side under forces imposed by the camshaft 7 and the hydraulic tappets 12 on the rocker arms 15. Therefore, there is a tendancy for a gap or clearance to be produced on the other side between the rocker arm shaft 16 and a portion of the bore 42 in the cylinder head 1 which supports the shaft 16. Therefore, the conventional oil supply system has a drawback in that when oil is delivered from the lubricating oil passage 40 into the bore 16*a* of the rocker arm shaft 16, a considerable amount of oil tends to leak from the gap formed between bore 42 and rocker shaft 16. As a consequence, the capacity of the oil pump 32 has to be greater than would otherwise be required for lubrication purposes just to make up for such oil leakage.

In view of the aforesaid problem, it is an object of the present invention to provide an oil supply device which suppresses leakage of the lubricating oil supplied to the bearing holes of rocker arms, thereby reducing the required capability of the oil pump used. To achieve this object, the present invention is characterized in that the oil supply passage communicating with the outlet port of the oil pump of the engine is connected to an oil reservoir chamber of the hydraulic tappet, and an interlinking mechanism has oil holes defined therein for communicating the oil reservoir chamber with the bearing hole of each rocker arm.

A further object of this invention is to provide an oil supply system wherein oil is supplied under pressure from the oil pump via the oil supply passage to the oil reservoir chamber of the hydraulic tappet as operating oil to the hydraulic tappet and also partly as lubricating oil to the bearing hole of the rocker arm through oil holes in the interlinking mechanism. The joints between members of the interlinking mechanism are held in contact under pressure by both the lifting action of the cam and the projecting movement of the hydraulic tappet. Therefore, any leakage of lubricating oil from the joints is extremely small.

Referring now to the drawings wherein a preferred embodiment is illustrated:

Figure 1:
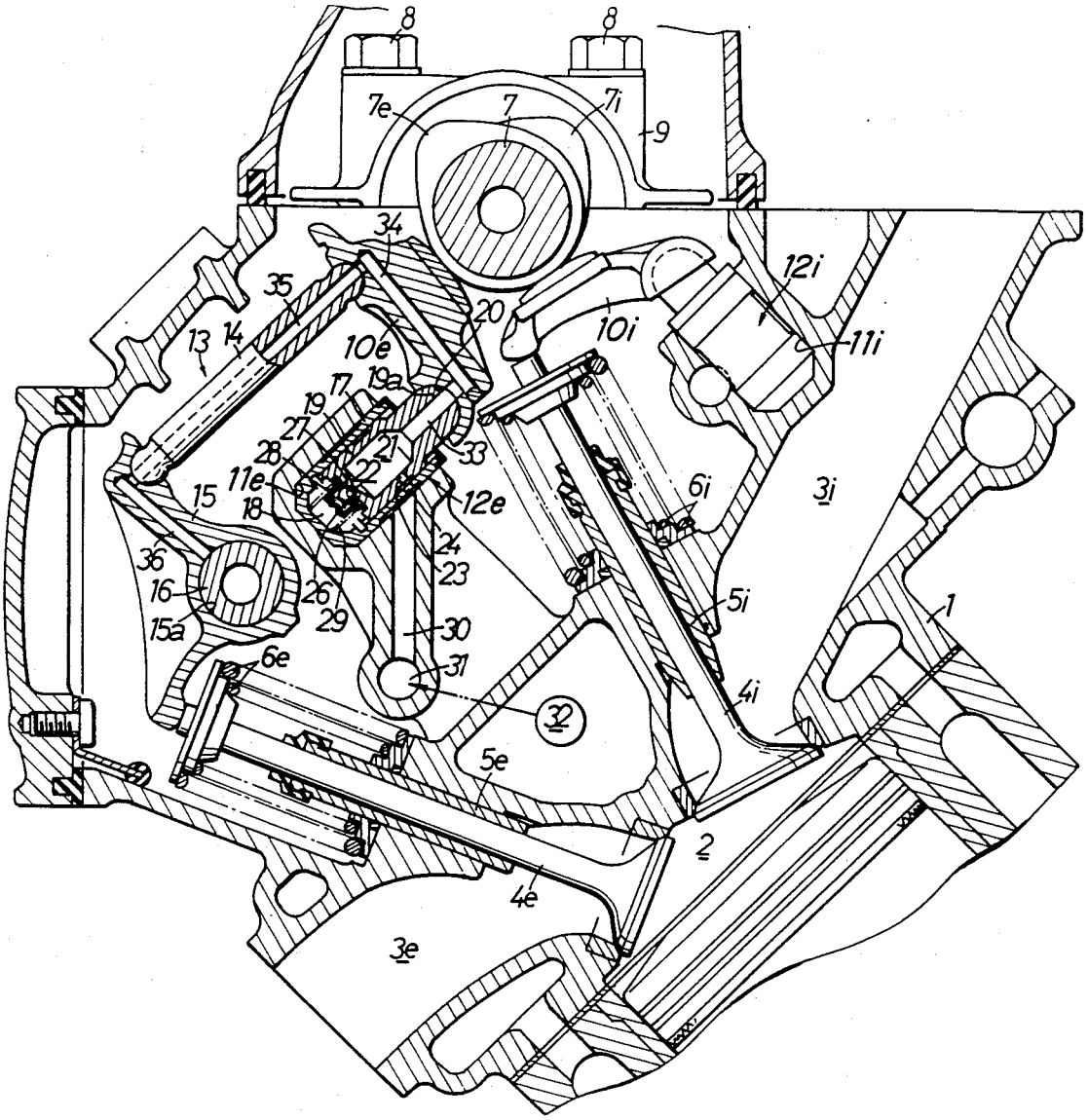
FIG. 1 is a fragmentary sectional end view of the cylinder head portion of an internal combustion engine with overhead valves and illustrating the preferred embodiment oil supply system of the present invention.
Figure 2:
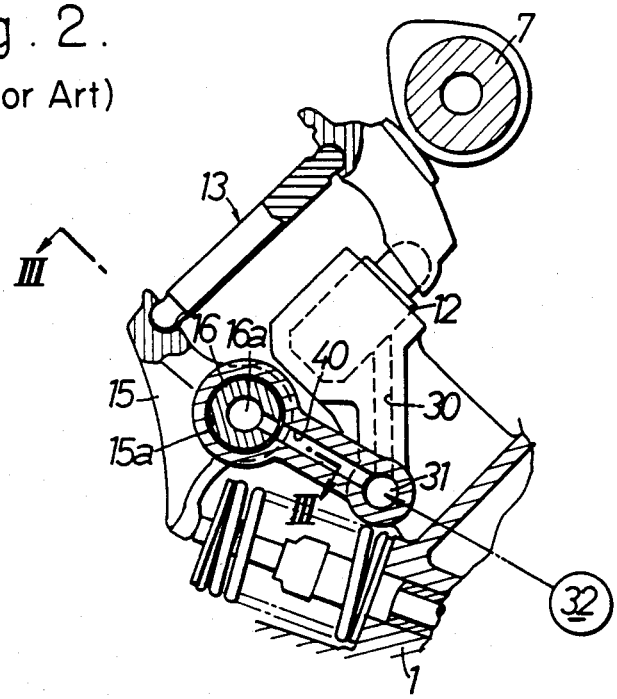
Fig. 2. (Prior Art)
FIG. 2 is a fragmentary sectional end view similar to FIG. 1 but illustrating a conventional oil supply system.
Figure 3:
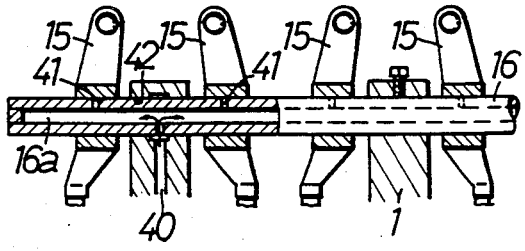
Fig. 3. (Prior Art)
FIG. 3 is a sectional plan view taken substantially on the line III—III in FIG. 2 illustrating the conventional oil suoply system.

The preferred embodiment of the present invention will hereinafter be described with reference to FIG. 1. An internal combustion engine includes a cylinder head 1 having combustion chambers 2 and intake and exhaust ports 3*i*, 3*e* which open into each of the combustion chambers 2. The intake and exhaust ports 3*i*, 3*e* can be opened and closed by respective intake and exhaust valves 4*i*, 4*e*.

The intake and exhaust valves 4*i*, 4*e* are axially slidably supported by valve guides 5*i*, 5*e*, respectively, in the cylinder head 1, and are normally urged to the closed position by valve springs 6*i*, 6*e*, respectively.

A single camshaft 7 operatively coupled to a crankshaft (not shown) is disposed substantially above the intake valves 4*i*. The camshaft 7 is rotatably supported by bearing caps 9 fastened by bolts 8 to the cylinder head 1. The camshaft 7 has intake cams 7*i* and exhaust cams 7*e* corresponding to the intake and exhaust valves 4*i*, 4*e*, respectively, with first cam followers 10*i* interposed between the intake cams 7*i* and the head or upper ends of the intake valves 4*i*. Each of the first cam followers 10*i* has an end pivotally supported by a first hydraulic tappet 12*i* mounted in a support hole 11*i* defined in the cylinder head 1.

Second cam followers 10*e* each have a side surface at their intermediate portions held in engagement with the exhaust cams 7*e* on the side of the camshaft 7 which is directed toward the exhaust valves 7*e*. Each of the second cam followers 10*e* has an opposite side surface having an upper end coupled through an interlinking mechanism 13 with the respective exhaust valve 4*e* and a lower end pivotally supported by a second hydraulic tappet 12*e* mounted in another support hole 11*e* defined in the cylinder head 1.

Each of the interlinking mechanisms 13 comprises a pusher rod 14 having one end engaging the upper end of the opposite side surface of one of the second cam followers 10*e*, and the other end engaging the bell-crank-shaped rocker arm 15 that in turn engages the head or upper end of one of the exhaust valves 4*e*. The rocker arms 15 are pivotally supported by a rocker arm shaft 16 in the cylinder head 1.

The first hydraulic tappets 12*i* are structurally identical to the second hydraulic tappets 12*e* and therefore only the construction of the second hydraulic tappets 12*e* will be described below.

Each of the hydraulic tappets 12*e* is principally comprised of a cylinder 17 and a plunger 19 held in slidable engagement with the inner peripheral surface of the cylinder 17 and defining a hydraulic pressure chamber 18. The cylinder 17 is fitted in one of the support holes 11*e* of the cylinder head 1. The plunger 19 has an outer spherical operating end 19*a* slidably engaging in a spherical recess 20 defined in the lower end of one of the cam followers 10*e*.

The plunger 19 has an internal oil reservoir chamber 21 and a valve hole 22 by which the oil reservoir chamber 21 communicates with the hydraulic pressure chamber 18. The oil reservoir chamber 21 communicates with an operating oil passage 30 defined in the cylinder head 1 through an oil hole 23 defined in the side wall of the plunger 19 and an oil hole 24 in the side wall of the cylinder 17. There is an operating oil passage 30 branched from the common oil supply passage 31 to each of the hydraulic tappets 12*e* which are arranged in a row normal to the sheet of FIG. 1. The oil supply passage 31 and the operating oil passages 30 are defined in the cylinder head 1 and the oil supply passage 31 is connected to the outlet port of an oil pump 32 (shown diagrammatically as a circle) of the engine. During operation of the engine, therefore, the oil reservoir chamber 21 of each of the hydraulic tappets 12*e* is filled with pressurized oil discharged from the oil pump 32.

In the inner end of the plunger 19, there is fitted a hat-shaped valve cage 26 accommodating therein a ball-shaped check valve 27 for opening and closing the valve hole 22 and a spring 28 for normally urging the check valve 27 to close the valve hole 22. The check valve 27 is opened when the oil pressure in the hydraulic pressure chamber 18 is lowered, and closed when the oil pressure therein is increased. The hydraulic pressure chamber 18 houses therein a pusher spring 29 for normally biasing the plunger 19 in a direction to project from the cylinder 17.

The plunger 19, the second cam follower 10*e*, the pusher rod 14, and the rocker arm 15 have oil holes 33, 34, 35, 36, respectively, which are interconnected at the joints where the plunger 19, the second cam follower 10*e*, the pusher rod 14, and the rocker arm 15 are operatively coupled. Thus, the oil reservoir chamber 21 in the second hydraulic tappet 12*e* is continually in communication with the bearing hole 15*a* of the rocker arm 15 via these oil holes 33 through 35.

The operation of the oil supply system of this invention will now be described. While the engine is in operation, the camshaft 7 is rotated by the crankshaft through a timing transmission device (not shown). When the engine initiates an intake stroke, the raised portion of the intake cam 7*i* pushes the first cam follower 10*i* which is pivoted about the first hydraulic tappet 12*i* toward the intake valve 4*i*. The intake valve 4*i* is now opened against the resilient force of the valve spring 6*i* to introduce an air-fuel mixture through the intake port 3*i* into the combustion chamber 2.

As the engine starts an exhaust stroke, the raised portion of the exhaust cam 7*e* pushes the second cam follower 10*e*. The second cam follower 10*e* is pivoted about the second hydraulic tappet 12*e* to push the pusher rod 14, thereby swinging the rocker arm 15 toward the exhaust valve 4*e*. The exhaust valve 4*e* is now opened against the resilient force of the valve spring 6*e* to discharge the exhaust gas from the combustion chamber 2 into an exhaust port 3*e*.

The first and second hydraulic tappets 12*i*, 12*e* operate in the same manner. Operation of the second hydraulic tappet 12*e* is as follows: When the cam 7*e* lifts the cam follower 10*e*, the cam follower 10*e* imposes a pushing force on the plunger 19. Since the check valve 27 remains closed at this time, a hydraulic pressure builds up in the hydraulic pressure chamber 18 to enable the plunger 19 to rigidly support the end of the cam follower 10*e*. As a result, the cam follower 10*e* is pivoted about the operating end 19*a* to push the pusher rod 14. During this time, oil in the hydraulic pressure chamber 18 leaks in a small quantity from a sliding clearance gap between the cylinder 17 and the plunger 19.

When the cam follower 10*e* is released from the lifting action of the cam 7*e*, the plunger 19 is forced by the pusher spring 29 to project outwardly until the slipper surface of the cam follower 10*e* engages the cam 7*e*. As the hydraulic pressure in the hydraulic pressure chamber 18 is lowered during the projecting movement of the plunger 19 under the resiliency of the pusher spring 29, the check valve 27 is opened to permit oil to be supplied from the oil reservoir 21 through the valve hole 23 into the hydraulic pressure chamber 18 for thereby making up for the oil leakage that has occurred from the hydraulic pressure chamber 18 during actuation of valve 4*e* as described above. Thus, any potential gaps associated with the valve operating mechanism, i.e., gaps at the joints between the members from the cam 7*e* to the valve 4*e* are eliminated.

Oil supplied under pressure from the oil pump 32 via the oil supply passage 31 and the operating oil passage 30 into the oil reservoir chamber 21 of the second hydraulic tappet 12*e* during engine operation is also supplied as operating oil into the hydraulic pressure chamber 18 from time to time. Part of the supplied oil is delivered from the oil reservoir chamber 21 successively to the oil holes 33, 34, 35, 36 for lubricating the junctions between the plunger 19, the second cam follower 10*e*, the pusher rod 14, and the rocker arm 15, and then delivered from the oil hole 36 to the bearing hole 15*a* of the rocker arm 15 to lubricate the surfaces of the rocker arm 15 and the rocker arm shaft 16 which pivot relative to each other. During this time, the joints between the plunger 19, the second cam follower 10*e*, the pusher rod 14, and the rocker arm 15 are held under pressure by the lifting action of the cam 7*e* and the resiliency of the pusher spring 29, so that any leakage of lubricating oil from those joints is extremely small.

According to the present invention, as described above, part of the oil supplied from the oil supply passage into the oil reservoir chamber of the hydraulic tappet is delivered as lubricating oil to the bearing hole of the rocker arm through the oil holes defined in the interlinking mechanism. Oil leakage from the joints of the interlinking mechanism which are held under pressure at all times is extremely small but adequate for the joints of the interlinking mechanism as well as the bearing hole of the rocker arm to be effectively lubricated. Consequently, the capability of the oil pump used can be minimized. Moreover, since the oil leakage is small, a desired hydraulic pressure can be maintained in the oil reservoir chamber for stabilized operation of the hydraulic tappet.

What is claimed:

1. In an oil supply system for a valve actuating mechanism of an internal combustion engine wherein said valve actuating mechanism includes a rocker arm pivotally mounted on a rocker shaft and engaging a head of a valve, a hydraulic tappet, and a cam follower and interlinking mechanism interconnecting the hydraulic tappet to the rocker arm for actuating the valve, an improvement comprising, an oil supply passage communicating with an oil reservoir chamber in the hydraulic tappet, and oil passage means in the rocker arm and cam follower and interlinking mechanism in mutual communication and communicating with the hydraulic tappet oil reservoir chamber and rocker shaft for supplying lubricating oil from said reservoir chamber to the rocker shaft.

2. The oil supply system of claim 1 wherein said cam follower and interlinking mechanism comprises a cam follower and a pusher rod, said pusher rod having one end engaging said rocker arm and another end engaging said cam follower, and said cam follower having an end engaging the hydraulic tappet.

3. The oil supply system of claim 2 wherein said pusher rod ends and cam follower end have spherical socket means for interengagement among the rocker arm, cam follower, pusher rod and hydraulic tappet, and said oil passage means communicate through said spherical socket means for continually lubricating said spherical socket means.

4. The oil supply system of claim 1 wherein said hydraulic tappet includes a sliding plunger having said oil reservoir chamber therein, said plunger having an oil passage in one end of said chamber in communication with the cam follower and interlinking mechanism, and said plunger having an oil passage in another end of said chamber with a check valve.

5. An oil supply system for an overhead valve actuating mechanism of an internal combustion engine, comprising, a rocker arm pivotally mounted on a rocker shaft and having one end engaging an overhead valve, a cam follower engaging a camshaft, a pusher rod extending between and connecting one end of the cam follower and other end of the rocker arm, a hydraulic tappet engaging another end of the cam follower, and oil passage means communicating to and through the hydraulic tappet, the cam follower, the pusher rod, and the rocker arm to the rocker shaft for lubricating the connections therebetween.

* * * * *